US009436120B1

(12) United States Patent
Watanabe et al.

(10) Patent No.: US 9,436,120 B1
(45) Date of Patent: Sep. 6, 2016

(54) IMAGE FORMING APPARATUS AND METHOD FOR FORMING A STREAKLESS IMAGE BY SETTING A POTENTIAL OF A DEVELOPING UNIT

(71) Applicants: KABUSHIKI KAISHA TOSHIBA, Tokyo (JP); TOSHIBA TEC KABUSHIKI KAISHA, Tokyo (JP)

(72) Inventors: Takeshi Watanabe, Yokohama Kanagawa (JP); Daisuke Ishikawa, Mishima Shizuoka (JP); Shoko Shimmura, Yokohama Kanagawa (JP)

(73) Assignees: Kabushiki Kaisha Toshiba, Tokyo (JP); Toshiba TEC Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/721,933

(22) Filed: May 26, 2015

(51) Int. Cl.
*G03G 15/06* (2006.01)

(52) U.S. Cl.
CPC ..... *G03G 15/065* (2013.01)

(58) Field of Classification Search
CPC ..... G03G 13/04; G03G 15/065
See application file for complete search history.

(56) References Cited

U.S. PATENT DOCUMENTS 5,840,452 A * 11/1998 Kitagawa ..... G03G 5/076 399/43
5,860,040 A * 1/1999 Shimizu ..... G03G 15/065 399/285
6,282,385 B1 * 8/2001 Suto ..... G03G 15/065 399/282
7,734,205 B2 * 6/2010 Sakaizawa ..... G03G 15/0812 399/284
2007/0077076 A1 * 4/2007 Yoshida ..... G03G 15/065 399/27
2008/0003003 A1 * 1/2008 Watanabe ..... G03G 15/043 399/49
2008/0063413 A1 * 3/2008 Zuber ..... B41J 29/393 399/15
2008/0101808 A1 * 5/2008 Shih ..... G03G 15/065 399/50
2008/0145078 A1 * 6/2008 Tomita ..... G03G 15/5058 399/60
2008/0166143 A1 * 7/2008 Watanabe ..... G03G 15/162 399/27
2008/0166159 A1 * 7/2008 Watanabe ..... G03G 15/0194 399/302
2009/0028591 A1 * 1/2009 Kubo ..... G03G 15/0266 399/50
2011/0142466 A1 * 6/2011 Willard ..... G03G 15/0848 399/55
2012/0114350 A1 * 5/2012 Sakoda ..... G03G 15/0173 399/55
2012/0207499 A1 * 8/2012 Willard ..... G03G 15/0813 399/53
2013/0259538 A1 10/2013 Watanabe et al.
2013/0322901 A1 * 12/2013 Nakase ..... G03G 15/08 399/49
2015/0042740 A1 * 2/2015 Suhara ..... G03G 15/043 347/118
2015/0177638 A1 * 6/2015 Suhara ..... G03G 15/043 399/177

FOREIGN PATENT DOCUMENTS

JP 2014128909 A 7/2014

OTHER PUBLICATIONS

Machine translation of JP 2014-128909.*

* cited by examiner

*Primary Examiner* — David Bolduc
(74) *Attorney, Agent, or Firm* — Patterson & Sheridan, LLP

(57) ABSTRACT

An image forming apparatus includes a photoreceptor, an exposure unit having a plurality of light emitting elements that are configured to emit light corresponding to an image to be formed towards the photoreceptor, a developing unit containing toner that is transferred to the photoreceptor therefrom, and a control unit configured to control a potential of the developing unit. The control unit is configured to control the potential of the developing unit, such that the toner is selectively transferred to a region of the photoreceptor that has received light of an intensity that is greater than a predetermined value. The predetermined value is equal to or greater than 40% and equal to or smaller than 60% of an average peak intensity of the plurality of the light emitting elements that are driven with a maximum current value.

16 Claims, 14 Drawing Sheets

FIG. 14

| MEAN BEAM DIAMETER→ | | 45 μm | | 60 μm | | 80 μm | |
|---|---|---|---|---|---|---|---|
| MAIN SCANNING RESOLUTION ↓ | THRESHOLD VALUE OF LIGHT INTENSITY | REPRODUCTION OF MICRO SPOT AND ADHESION OF CARRIER | STREAK UNEVENNESS | REPRODUCTION OF MICRO SPOT AND ADHESION OF CARRIER | STREAK UNEVENNESS | REPRODUCTION OF MICRO SPOT AND ADHESION OF CARRIER | STREAK UNEVENNESS |
| 600dpi | 20% | ○ | × | ○ | × | ○ | × |
| | 30% | △ | △ | ○ | △ | ○ | △ |
| | 40% | × | ○ | ○ | ○ | ○ | ○ |
| | 50% | × | ○ | △ | ○ | ○ | ○ |
| | 60% | × | ○ | × | ○ | △ | ○ |
| | 70% | × | × | × | × | × | × |
| 1200dpi | 20% | ○ | × | ○ | × | ○ | × |
| | 30% | ○ | △ | ○ | △ | ○ | × |
| | 40% | ○ | ○ | ○ | ○ | ○ | ○ |
| | 50% | △ | ○ | ○ | ○ | ○ | ○ |
| | 60% | × | ○ | △ | ○ | ○ | ○ |
| | 70% | × | × | × | × | ○ | × |

STREAK UNEVENNESS

○: NO INCRESE IN STREAK IN ±30 μm

△: SLIGHT INCRESE IN STREAK IN ±30 μm (OK LEVEL)

×: INCREASE IN STREAK IN ±30 μm (NO GOOD)

REPRODUCTION OF MICRO SPOT AND ADHESION OF CARRIER

○: GOOD REPRODUCTIVITY AND NO FOGGING

△: IN OK RANGE EVEN THOUGH EITHER IS A LITTLE NO GOOD

×: EITHER IS IN NO GOOD LEVEL

IMAGE FORMING APPARATUS AND METHOD FOR FORMING A STREAKLESS IMAGE BY SETTING A POTENTIAL OF A DEVELOPING UNIT

FIELD

Embodiments described herein relate generally to an image forming apparatus that forms an image using an exposure device.

BACKGROUND

An image forming apparatus forms an image using an exposure device including a plurality of light emitting elements, such as LEDs, arranged along a photoreceptor. The light emitted from the light emitting elements is focused on the photoreceptor through a lens array, and an electrostatic latent image is formed on a region of the photoreceptor at which the light is irradiated.

In such an image forming apparatus, as the light emitting elements and the lenses may have non-uniform optical characteristics and may be disposed non-uniformly, a light intensity distribution on the photoreceptor may be non-uniform. Thus, when a plain image, such as a half-tone image, is formed, a streak-shaped density unevenness (vertical streak and streak unevenness) may appear in the image.

One way to reduce the density unevenness is independently adjusting a light spot size formed on the photoreceptor by independently adjusting a current supplied to each of the light emitting elements. However, as a focal depth of the lens array is usually very narrow, the light intensity distribution is very sensitive to a positional change of the lens array and the light emitting elements. Thus, the adjustment of the light spot size needs to be performed with precision.

DESCRIPTION OF THE DRAWINGS

FIG. 14 illustrates an experiment result with respect to a relationship between developing bias Vb and quality of an image formed, including density unevenness.

DETAILED DESCRIPTION

In general, according to one embodiment, an image forming apparatus includes a photoreceptor, an exposure unit having a plurality of light emitting elements that are configured to emit light corresponding to an image to be formed towards the photoreceptor, a developing unit containing toner that is transferred to the photoreceptor therefrom, and a control unit configured to control a potential of the developing unit. The control unit is configured to control the potential of the developing unit, such that the toner is selectively transferred to a region of the photoreceptor that has received light of an intensity that is greater than a predetermined value. The predetermined value is equal to or greater than 40% and equal to or smaller than 60% of an average peak intensity of the plurality of the light emitting elements that are driven with a maximum current value.

Hereinafter, embodiments will be described with reference to drawings.

Figure 1:
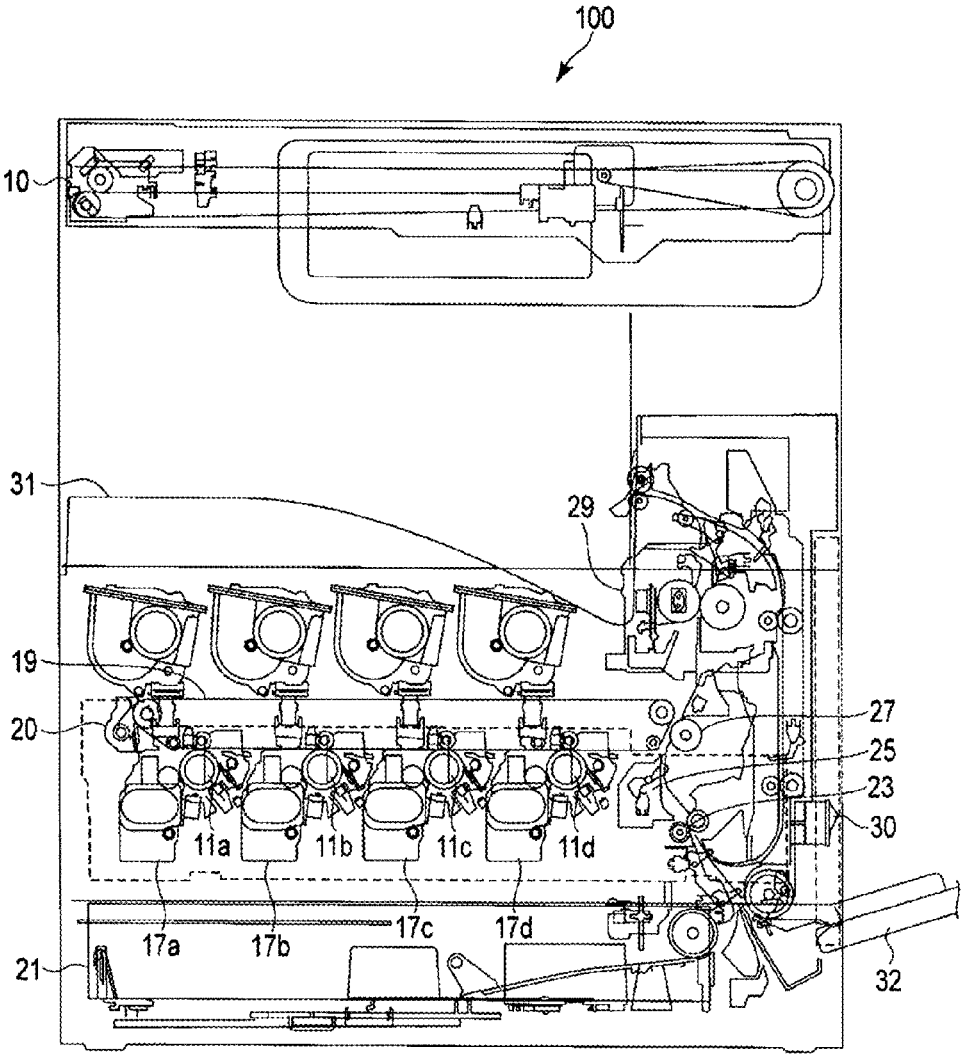
FIG. 1 illustrates a front cross-sectional view of an image forming apparatus according to an embodiment.

FIG. 1 is a perspective front view an image forming apparatus 100 according to an embodiment.

The image forming apparatus 100 illustrated in FIG. 1 includes first to fourth photosensitive drums 11*a* to 11*d* as image carriers which hold latent images, and developing devices 17*a* to 17*d* which supply a developer to the latent images which is held on the photosensitive drums 11*a* to 11*d* to form developer images. In addition, the image forming apparatus 100 further includes a transfer belt 19 which receives the developer images which are held in the photosensitive drums 11*a* to 11*d* in order, a cleaner 20 which removes the developer which remains on the transfer belt 19, and a secondary transfer roller 27 which transfers the developer image held on the transfer belt 19 to a sheet such as plain paper or a resin sheet such as an OHP sheet. In addition, the image forming apparatus 100 includes a fixing device 29 which fixes on the sheet the developer image which is transferred to the sheet using the secondary transfer roller 27, an exposure device which forms latent images on the photosensitive drums 11*a* to 11*d*, and the like. The exposure device will be described in detail below.

In addition, the image forming apparatus 100 includes a scanner unit 10 which reads the original document and a main power supply switch 30.

The first to fourth developing devices 17*a* to 17*d* accommodate developers of arbitrary colors of Y (yellow), M (magenta), C (cyan), and Bk (black) which are used in order to obtain a color image, and visualizes latent images which are respectively held on the photosensitive drums 11*a* to 11*d* using any one of colors of Y, M, C, and Bk. The order of each color is determined according to an image forming process or properties of the developers.

The transfer belt 19 holds a developer image of each color which is formed using the first to fourth photosensitive drums 11*a* to 11*d* and the developing devices 17*a* to 17*d* in the order of processing and conveys the developer image to a transfer position at which the developer image is transferred onto a sheet such as plain sheet, or a resin sheet such as an OHP sheet.

A sheet feeding cassette 21 accommodates a sheet of an arbitrary size, and a pickup roller (not illustrated) takes out the sheet from a corresponding cassette according to an image forming operation. The size of the sheet corresponds to a magnification rate which is requested when forming an image, and a size of the original image.

A resist roller 23 and a control unit 25 for maintaining image quality sends a selected sheet to the transfer position at which the secondary transfer roller 27 comes into contact with the transfer belt 19 at timing at which the secondary transfer roller 27 performs transfer of the developer image from the transfer belt 19.

It is also possible to transfer the developer image onto a sheet supplied from a manual tray 32 as necessary.

The sheet onto which the developer image is transferred by the secondary transfer roller 27 is discharged to a sheet discharging tray 31 after the developer image is fixed on the sheet in a fixing device 29.

Figure 2:
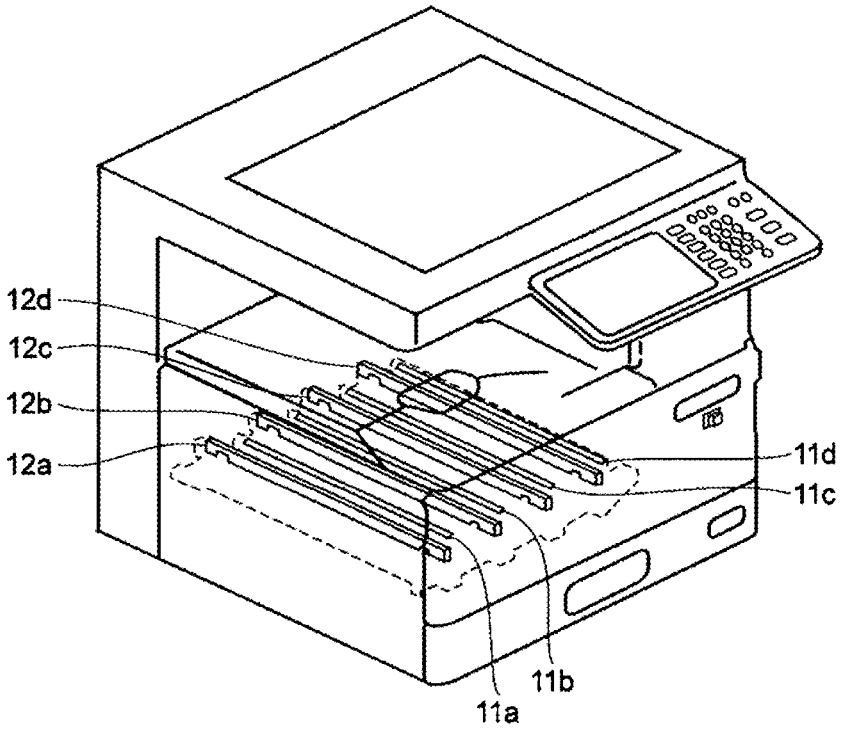
FIG. 2 is a perspective view of an image forming unit of the image forming apparatus.
Figure 3:
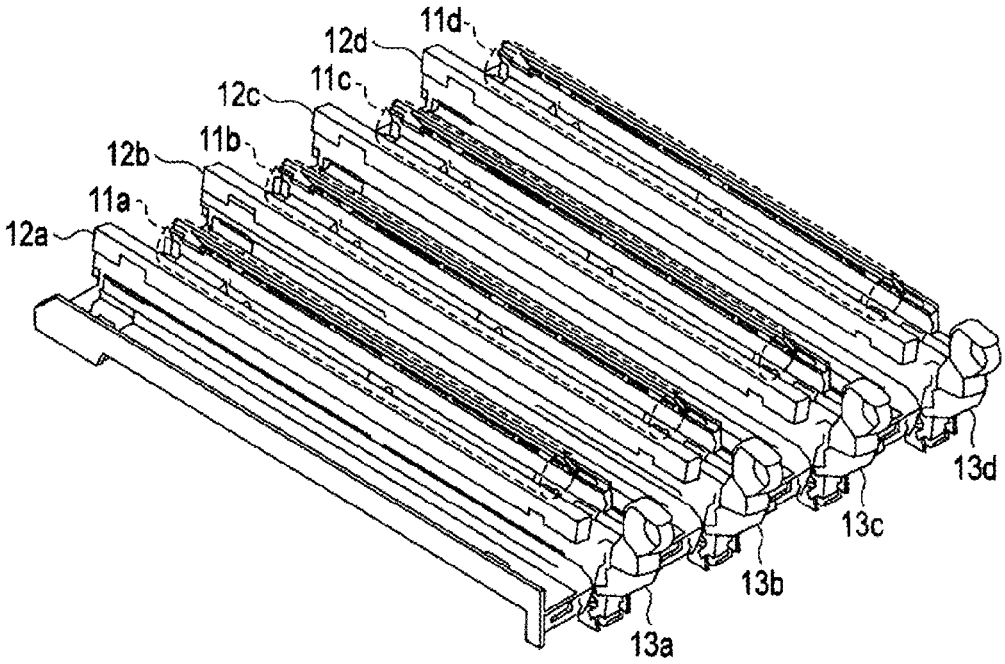
FIG. 3 is a schematic view of the image forming unit.

FIG. 2 is a perspective view of an image forming unit of the image forming apparatus. As illustrated, LED print heads 12*a* to 12*d* are respectively disposed adjacent to the first to fourth photosensitive drums 11*a* to 11*d*. Each of the photosensitive drums 11*a* to 11*d* have a longitudinal shape in a direction perpendicular to a rotational direction (longitudinal direction), and the LED print heads 12*a* to 12*d* are disposed along the longitudinal direction. As illustrated in FIG. 3, LED print head abutment and separation levers 13*a* to 13*d* are provided to a corresponding pair of one of the photosensitive drums 11*a* to 11*d* and one of the LED print heads 12*a* to 12*d*.

In the image forming unit, each of the photosensitive drums 11*a* to 11*d* is irradiated with LED light corresponding to a digital image signal sent from a scanner, a USB, a network, or the like, and a latent image is formed on each of the photosensitive drums 11*a* to 11*d*. The LED light corresponding to the image signal is radiated to each of the photosensitive drums 11*a* to 11*d* using the LED print heads 12*a* to 12*d*, respectively.

Figure 4:
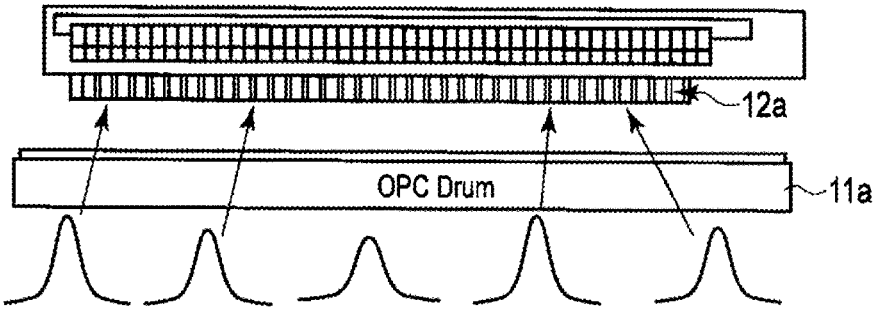
FIG. 4 is a schematic view of an LED print head of the image forming unit in a longitudinal direction.

FIG. 4 illustrates a schematic configuration of the LED print head 12*a* in the longitudinal direction, and beam distribution profile of some light sources of the LED print head 12*a*. As illustrated in FIG. 4, the LED print head 12*a* has a shape extending along the longitudinal direction of the photosensitive drum 11*a*, and includes a plurality of light emitting elements and a plurality of lenses. Since there are many light emitting elements and lenses, beam distribution profiles of the light emitted from the light sources of the LED print head are not uniform. As illustrated in FIG. 4, the beam distribution profiles are non-uniform.

Figure 5:
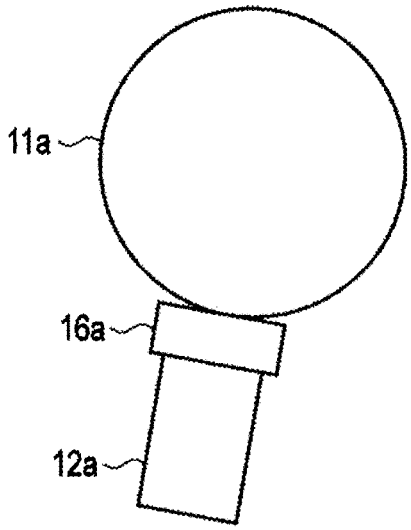
FIG. 5 is a schematic view of a photosensitive drum and the LED print head of the image forming unit.

As illustrated in FIG. 5, a gap spacer 16*a* is disposed between the photosensitive drum 11*a* and the LED print head 12*a* and a fixed gap is created thereby. The gap spacer 16*a* is a periodically replaced component as the size of the gap changes according to abrasion of the gap spacer 16*a*. Setting of a distance (gap) between the photosensitive drum 11*a* and the LED print head 12*a* will be described in detail below.

Figure 6:
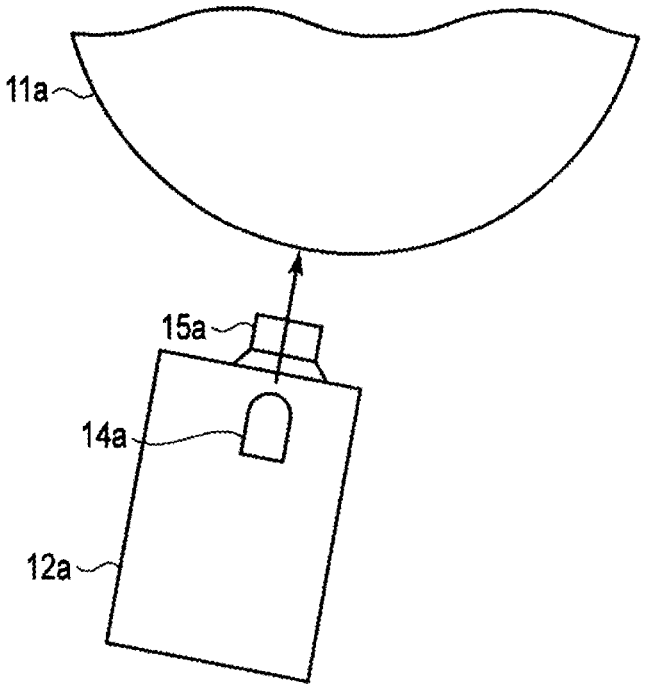
FIG. 6 is an enlarged view of the LED print head.

As shown in the enlarged view illustrated in FIG. 6, the LED print head 12*a* includes an LED 14*a* (light emitting diode) as a light emitting element, and the LED light is radiated to the photosensitive drum 11*a* through a lens 15*a*. A focal depth of the lens 15*a* on the photosensitive drum 11*a* is assumed to be approximately ±15 μm.

A latent image which is formed on the surface of the photosensitive drum 11*a* according to irradiation with the LED light is developed when a developer is supplied from the developing device.

Figure 7:
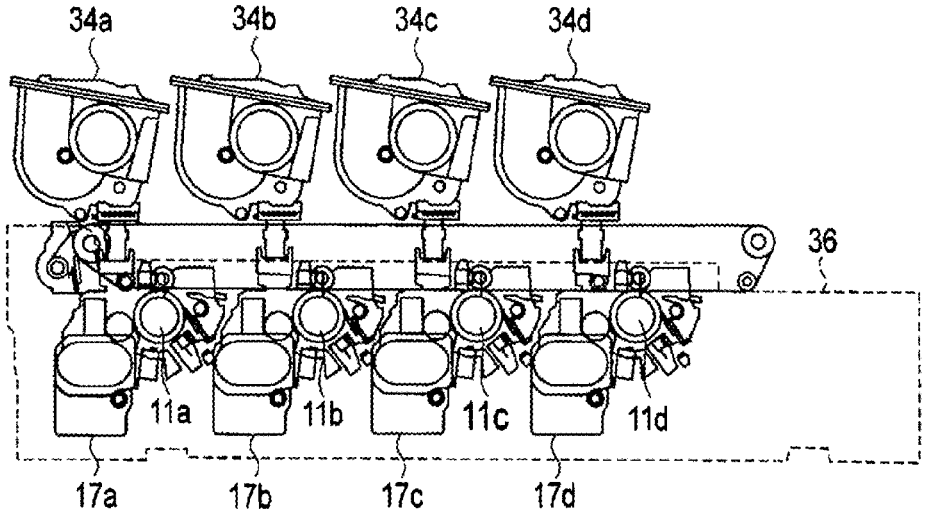
FIG. 7 is a schematic view of a developing device of the image forming unit.

As illustrated in FIG. 7, developers are supplied to the developing devices 17*a* to 17*d* from developer supply devices 34*a* to 34*d*, respectively. According to the embodiment, a two-component developer containing toner particles and carrier particles is used for the developers. The two-component developer includes, for example, toner with a diameter of 4 μm to 12 μm, containing external additive with a diameter of 4 μm to 10 μm which is formed of a polyester-based resin, an acrylic resin, silica, or the like, in ferrite carrier with a diameter of 30 μm to 60 μm of which the surface is coated with a resin such as a silicone-based resin and an acrylic resin, by 3% to 20% in a weight ratio. The toner may be toner manufactured using a grinding method or a polymerization method. In addition, the carrier may be a region in which a magnetic substance is dispersed, instead of the ferrite carrier having a core formed of the ferrite.

The developers are agitated in the developing devices 17*a* to 17*d*, respectively. As a result, toner particles are charged to a negative polarity due to abrasion thereof, and the carrier particles are charged to a positive polarity. The charged toner particles are supplied to the surface of each of the photosensitive drums 11*a* to 11*d*, respectively, using magnetic rollers (not illustrated), and are adhered to the surface of the photosensitive drum at which a potential is lower than a developing bias applied to the magnetic roller. According to the embodiment, a DC bias of a potential Vb for visualizing a latent image is applied to the magnetic roller as the developing bias. The developing bias Vb which is applied to the developing device 17 (respective 17*a* to 17*d*) will be described in detail below.

Through such a process, images are formed on the surfaces of the photosensitive drums 11*a* to 11*d*, respectively. A developer which is not used in image forming is collected in a waste developer box 36.

Figure 8:
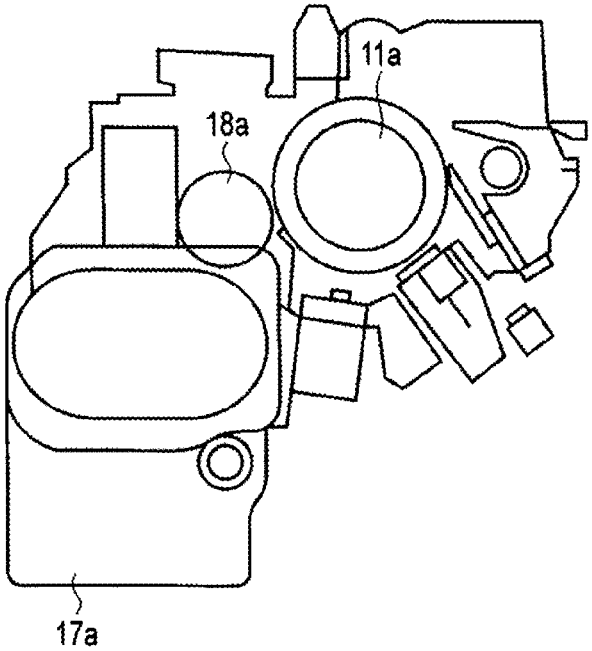
FIG. 8 is an enlarged view of the developing device and a photosensitive drum.

As illustrated in FIG. 8, the developing device 17*a* includes a developing drum 18*a* which is disposed so as to face the photosensitive drum 11*a*. The latent image which is formed on the surface of the photosensitive drum 11*a* is developed (visualized) when the developer is supplied to the surface of the photosensitive drum 11*a* from the developing drum 18*a*.

A general technical issue of the LED print head in which an LED is used for a light source will be described with reference to FIG. 4. In the LED print head 12*a*, an LED or an OLED which is used for the light source is small; however, there are incomparably more light emitting points (that is, light source) relative to a laser optical system, or the like, and many lenses formed as a lens array such as the SELFOC lens array is used. As optical characteristics of each light source (or each lens) and the arrangement thereof may not be uniform, the light irradiating property of the LED print head 12 a may not be uniform in the main scanning direction. If beam distribution profiles of the light emitting points are different, density irregularity in a streak shape (vertical streak) may be generated when a half-tone image is printed.

Figure 9A:
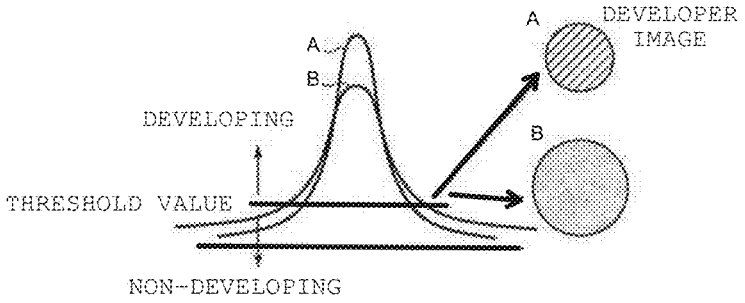
FIGS. 9A and 9B are conceptual diagrams illustrating a beam diameter correction.
Figure 9B:
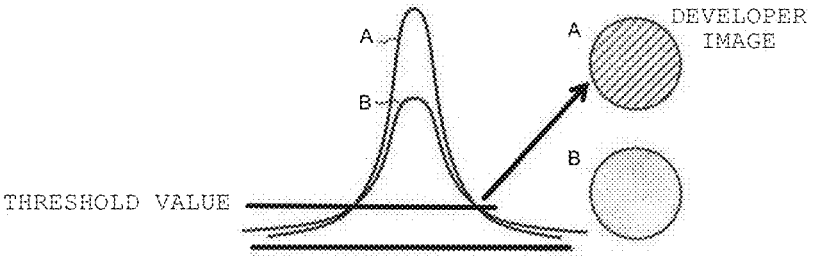

For this problem, in general, the vertical streak is removed by performing a correction process, which is referred to as a dot diameter correction, with respect to the exposure device. FIGS. 9A and 9B are conceptual diagrams which illustrate the dot diameter correction.

In general, the dot diameter correction is a process in which a light intensity of beam which is condensed is set to be larger so that dot diameters of an latent image spot (an area having a potential higher than a developing threshold value (upper side)) are the same when there are two types of beam distribution profiles. In FIG. 9B, the beam diameter is adjusted so as to be 65 μm at a position with a constant height. Although a light intensity is different among the light emitting points, it is possible to perform uniform developing, and to remove the vertical streak in a toner image formed on the photoreceptor by setting an area of the beam spot, which leads to developing of the toner, to be equal.

In many cases, the dot diameter correction is performed by individually setting a current value of a current supplied to each LED. In this case, a ROM element (storage medium) is built in the LED head, and correction data for each LED is stored in the ROM element in advance. When a main body of an apparatus such as a copy machine or a printer is operated, the data is transmitted to the main body, and a current value for each LED is controlled by a control unit such as a CPU of the main body. Usually, in the LED print head, since a correction process of a current value, or the like, corresponding to a beam distribution profile is performed with respect to each LED, individually. If the correction process may be optimally maintained, the streak may not be generated even in a half-tone image.

However, as the focal depth of the lens array is extremely narrow, even when the focus of the lens is shifted only by ±30 μm, a beam distribution profile of each light emitting point is remarkably changed, and the beam diameter correction is not preferably performed.

Usually, in an image forming apparatus such as a mass-produced printer, it is difficult to keep a distance (gap) between the LED head and the photoreceptor, which is rotating, within ±30 μm from a setting value over the entire region in the exposure width. In order to keep the gap between the LED head and the photoreceptor constant, it is necessary to manage the gap precisely using an expensive component or to frequently exchange a holding member (gap spacer 16*a*), or the like, which maintains the gap.

Figure 10:
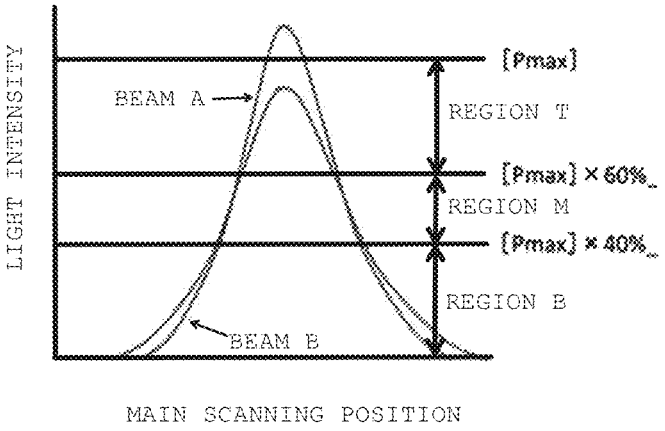
FIG. 10 is a schematic view of a beam distribution profile of a single light emitting element.

According to the embodiment, it is possible to cope with the above described issue using the following method. FIG. 10 schematically illustrates a beam distribution profile of a light emitting point. Here, when a mean value of a peak value of beam A and a peak value of beam B, of which integrated light intensities are equal, is set to Pmax, a range of the light intensity of 40% to 60% of Pmax is a range of M in FIG. 10.

If the beam distribution profile is changed from the one of the beam A to the one of the beam B due to a focal shift or the like, a difference of the beam diameter in the range M (width in horizontal direction in figure) is smaller than a range T on the top and a range B in the bottom. In the embodiment, the photoreceptor which is charged to V0 is irradiated with light having an effective spot diameter in the range M; in other words, a potential of the DC bias (developing potential Vb) which is applied to the developing device is set to a value such that toner is retained on the spot in the range M., it is possible to make the beam diameter in the range M contribute to developing largely. According to such a setting, it is possible to achieve an image forming apparatus which is robust against fluctuation of the beam distribution profile.

According to the embodiment, an LED print head (exposure device) 12 (12*a* to 12*d*) including a plurality of light emitting points (LEDs) is used. A condition of a setting value of the potential Vb of the DC bias applied to the developing device 17 (17*a* to 17*d*) is defined as the following condition (1).

Condition (1): With respect to a light intensity distribution profile of a light emitting point (one dot) for exposure, when a mean peak light intensity of the entire light emitting points along the LED print head is set to Pmax, the setting value should be in a range such that when the photosensitive drum 11 (photoreceptor) charged at a predetermined potential V0 is irradiated with light, a spot at which a light intensity of the light is in a range from 40% or more to 60% or less of Pmax retains toner.

According to the embodiment, this setting is particularly effective when a pixel density of the light emitting points of the LED print head 12 (exposure device) is 1,200 dpi or more (fine).

It is preferable to adjust a total light energy of each light emitting point of the LED print head 12 (exposure device) to be the same as each other, or be equal as much as possible. Data of a current value which is supplied to each light emitting point after the adjustment is stored in the ROM element (storage medium) of the LED head as correction data for each light emitting point.

Since it is difficult to individually adjust a physical distance between the photosensitive drum 11 and each light emitting point, it is preferable to adjust the distance so as to be at a position at which a peak mean value of each light emitting point as the head becomes the highest; however, in practice, a peak mean value of each head in a focal distance (specification) which is incorporated in a product is applied as a standard.

An experiment result of the above described embodiment will be described below.

An exposure device which is used in the experiment is an LED head of which resolution is 600 dpi and 1,200 dpi manufactured by Oki Digital Imaging Corporation, and the number of light emitting points is 7,296 in 600 dpi, and 14,000 or more in 1,200 dpi. A ROM is built in the LED head, and correction data of each light emitting point is stored therein. Then, the correction data is transmitted to a storage unit of the main body of an image forming apparatus stored therein, and fed back to the exposure device by a control unit of the image forming apparatus when the LED is driven.

As to the photoreceptor, an organic photoreceptor which is manufactured by Ricoh Co., Ltd. is used. Further, a two component developing device, which includes toner manufactured using a grinding method and carrier particles, is used.

In addition, a measurement of a beam distribution profile in the main scanning direction is performed by irradiating a slit having a width of 5 μm with a beam from an LED head at an angle of 90° with respect to the main scanning direction, and by measuring an intensity of light which passes through the slit using a photodiode. It is possible to measure a light intensity distribution in the main scanning direction in a unit of 5 μm by moving a measurement unit which is equipped with the slit and the photodiode by 5 μm in the main scanning direction of the LED head. It is possible to measure the light intensity in the unit 5 μm also by performing continuous scanning while monitoring the movement distance of the measurement unit. An output of the photodiode is a relative value; however, the value may be used as is.

The beam spot diameter of the light and the beam distribution profile depend on the size of the LED and a focal length of the lens array. Usually, the light emitting surface of the LED has a substantially quadrangle structure (in addition, electrode is overlapped with a part thereof) of which side lengths are 10 μm or more, and a beam spot diameter in the main scanning direction of a 13.5% height (1/e2) at a focal point position through a lens is 40 μm to 80 μm. A peal light intensity of an individual beam depends on the size of the LED and a focal length of the lens array.

Figure 11A:
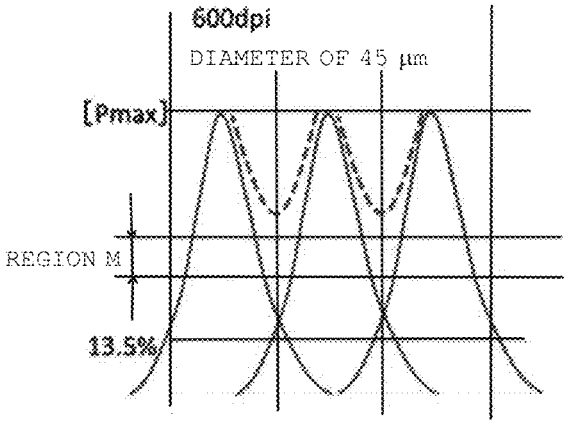
FIGS. 11A and 11B are conceptual diagrams illustrating a combined beam distribution of a plurality of light emitting elements when a beam spot diameter is 45 μm.
Figure 11B:
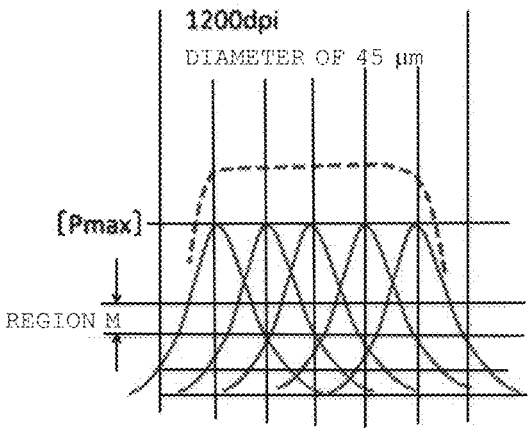

FIGS. 11A and 11B are conceptual diagrams illustrating beam distribution profiles when a beam spot diameter is 45 μm. FIG. 11A illustrates a case of 600 dpi and when all of LEDs are turned on. A total light intensity distribution corresponding to the aggregation of the beams from the LEDs that are overlapped is denoted by a dot line. As shown in FIG. 11A, a peak value in the aggregated light intensity distribution does not exceed a peak value of the light intensity distribution of an individual light emitting point.

Figure 12A:
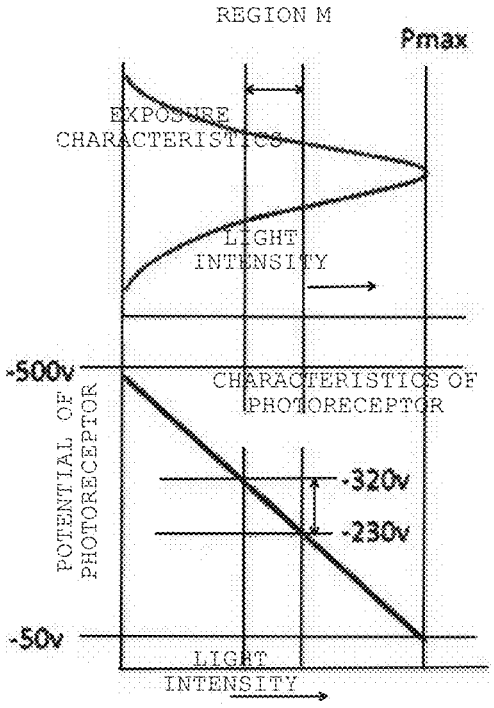
FIGS. 12A and 12B are diagrams which illustrate a beam distribution profile and a relationship between light intensity and potential of the photosensitive drum.
Figure 12B:
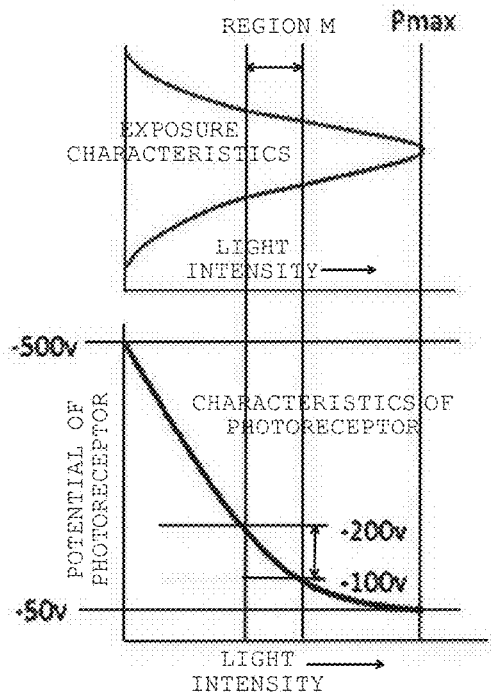

FIGS. 12A and 12B illustrate relationships between a beam distribution profile and variation of the potential of a photoreceptor with respect to variation of the light intensity. In FIG. 12A, the potential of the photoreceptor is a straight line shape. For example, when a charging potential of the photoreceptor with a light intensity of −500 V (Pmax) changes up to −50 V, an appropriate range of Vb is −500−(−500−(−50)×0.4 to 0.6)=−230 to −320 V.

However, in many cases, in a range corresponding to the light intensity of Pmax, a sensitivity of the photoreceptor is set in a saturation region rather than a linear region by taking reproducibility of a thin line image or a stability of the potential of the photoreceptor into consideration. In the characteristics of the photoreceptor in FIG. 12B, an appropriate range of Vb is −100 to −200V, and the value is lower compared to a case in which the characteristics of the photoreceptor is set in the linear region.

Since the charging potential of the photoreceptor is −500 V in the example, a difference between Vb and the charging potential is 180 V to 270 V in a case of FIG. 12A, and 300 V to 400 V in a case of FIG. 12B. The difference between the charging potential and the developing bias Vb is referred to as a background contrast. When a two component developer is used, if the background contrast is too large, adhesion of a carrier to the photoreceptor occurs. A value of the background contrast that causes the adhesion of the carrier is determined due to characteristics of toner and the carrier; however, when the value exceeds 200 V, the issue of the adhesion becomes serious.

In addition, when there is a large background contrast, it is difficult to reproduce a thin line image, and it is necessary to make a light intensity large in order to compensate the contrast. However, when the light intensity is large an appropriate value of Vb is small and the background contrast becomes large. In view of this tendency, it is important to find a condition in which all of these attributes are appropriate.

FIG. 11B is a conceptual diagram illustrating a beam distribution profile when the beam diameter is 45 μm and the light emitting points are arranged at 1,200 dpi. Light intensity energy itself in each beam becomes ½ compared to a case of 600 dpi in FIG. 11A, and Pmax in each beam also becomes small. As a matter of course, a level in a range M becomes low. However, a total light intensity per unit area (dotted line in figure) becomes the same level as that in the case of 600 dpi because adjacent beams overlap with each other. That is, when density of the light emitting points in the main scanning direction is increased to 1,200 dpi from 600 dpi, Pmax of each light emitting point is lowered and the range M is also lowered. When the range M is lowered, the background contrast is also lowered, and a range in which the adhesion of carrier does not occur and a thin line image can be formed increases.

Figure 13:
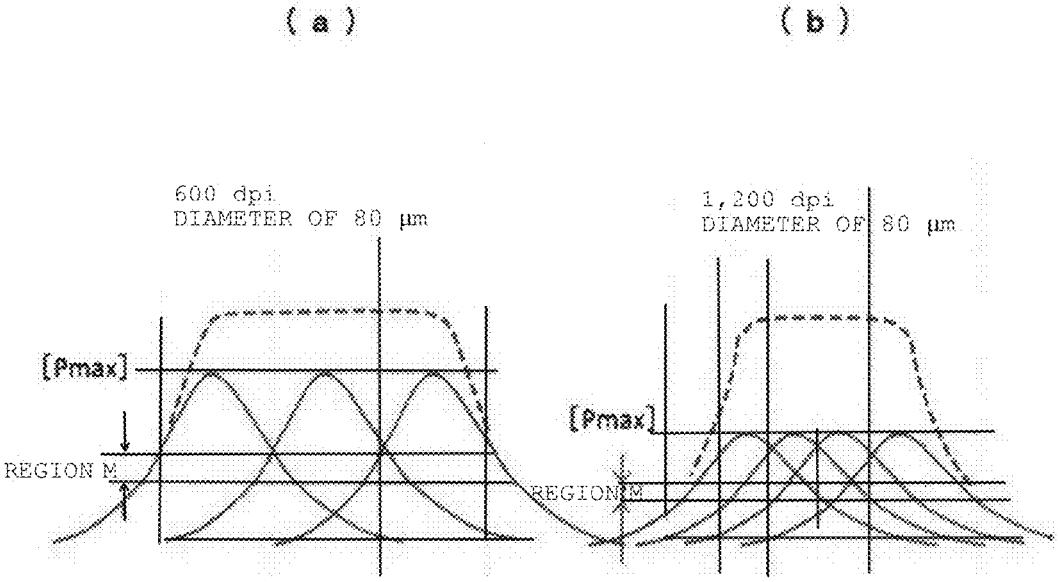
FIG. 13 illustrates a combined beam distribution of a plurality of light emitting elements when abeam spot diameter is 80 μm.

FIG. 13 is a schematic diagram illustrating beam distribution profiles when a beam diameter is 80 μm. FIG. 13(*a*) shows a case in which the density of the light emitting points is 600 dpi. In FIG. 13(*a*), since a beam diameter is large, Pmax becomes smaller than a total light intensity. That is, it becomes a range in which the background contrast is more preferable compared to a case in which the beam diameter is 45 μm.

FIG. 13(*b*) is a schematic diagram when a beam diameter is 80 μm and the density is 1,200 dpi. Since Pmax becomes smaller compared to the case of 600 dpi, the background contrast becomes smaller. Meanwhile, when the density is 1,200 dpi, and a beam diameter is 80 μm, a region at the foot of a beam of an adjacent light emitting point is slightly overlapped with the range M of a beam in the horizontal end in the figure which corresponds to an edge of a line. When the overlap becomes large, even if Vb is set to the range M, in a substantial developing threshold value, when the beam distribution profile is changed due to a focal shift of an adjacent beam, or the like, in the range M, a beam diameter in the region at the foot of the beam is remarkably changed, and density unevenness of a streak shape easily occurs. That is, in a case of 600 dpi, when the beam diameter is larger, the density unevenness decreases. To the contrary, in a case of 1,200 dpi, when the beam diameter exceeds 80 μm, the density unevenness occurs.

FIG. 14 illustrates a result in which formation of the thin line image and reproduction of micro spots and adhesion of carrier, which is undesirable, are examined by changing a setting value of a beam diameter and Vb when it is 600 dpi and 1,200 dpi.

As for the formation of the thin line image (streak unevenness), whether or not the thin line image is noticeable is examined by printing a half-tone image by shifting an LED by ±30 μm from a focal point position, after making the thin line image unnoticeable by performing a dot diameter correction process in a focused state.

According to the result, in any of combinations, when Vb is set so as to correspond to 40% to 60% of Pmax, it is possible to obtain a stable image quality with almost no increase in the thin line image, even when the focal point is shifted.

Meanwhile, as for the micro spots and the adhesion of carrier to the photoreceptor, in a case of 600 dpi, when the beam diameter is small, the background contrast becomes large, and it is difficult to reduce the micro spots and the adhesion. When the beam diameter becomes larger, it is possible to reduce the micro spots and the adhesion as well as the thin line image. In addition, in a case of 1,200 dpi, the range of Vb in which the thin line image and the micro spots and the adhesion are both reduced are increased compared to the case of 600 dpi.

In addition, in order to determine the existence of the streak unevenness, a dot diameter correction process is performed in a state of being focused such that the streak unevenness is unnoticeable; however, when Vb is set so as so correspond to the range of 40% to 60% of Pmax, a correction value itself becomes very small, and the streak unevenness is almost unnoticeable even when the dot diameter correction is not performed. As described above, the beam diameter in the vicinity of ½ of the peak light intensity value is only slightly changed even when the beam distribution profile is changed. Thus, it is possible to reduce the streak unevenness simply by adjusting a light intensity to be constant without performing the dot diameter correction.

Since adjusting of the light intensity may be performed without being remarkably influenced even when the head and the focal point of the sensor vary to some extent, it is possible to perform a stable correction when a mechanical accuracy is moderated during performing the correction with respect to the LED, and to save cost and time which are necessary for the adjustment.

In this manner, according to the embodiment, it is possible to suppress an occurrence of the streak unevenness even when a focal point position fluctuates, by setting a potential of the developing device to be in a specific range.

On the other hand, in the developing device, an amount of developing toner adhered on the photoreceptor in a constant potential is changed when a charging amount of a developer (toner) is changed due to a fluctuation in ambient circumstance, or the like. To make the amount of the developing toner constant, it is necessary to perform a control of changing a potential of the developing device according to a change in charging amount of toner using a control unit such as a CPU, or the like, of the apparatus main body.

For example, in a hot and humid environment (30° C. and humidity of 85%), a charging amount of toner decreases, and Vb of the developing bias, which is −300 V in an environment of a normal temperature and normal humidity, decreases to approximately −200 V. On the other hand, in an environment of a low temperature and low humidity (10° C. and humidity of 20%), Vb, which is −300 V in the normal environment, increases up to approximately −400 V.

At this time, in a conventional image quality maintaining control, adhesion of carrier, fogging, or the like, is suppressed by changing the charging potential of the photoreceptor in accordance with the change of the developing bias by the same value. On the other hand, when this method is used in the embodiment, Vb deviates from an appropriate range, and the streak unevenness may increase.

Therefore, it is preferable to control V0 V of the photoreceptor non-linearly with respect to a fluctuation of Vb of the developing device so as to satisfy the above described condition (1), without changing the charging potential by the same value, even though the charging potential of the photoreceptor is also changed according to a change in Vb of the developing bias.

Specifically, when Vb of the developing device decreases, V0 of the charging potential of the photosensitive drum 11 is decreased so that the background contrast, which is a difference between the V0 of the photosensitive drums 11 (11*a* to 11*d*) and the Vb of the developing devices 17 (17*a* to 17*d*), becomes small. When Vb of the developing device 17 increases, V0 of the charging potential of the photosensitive drum 11 is increased so that the background contrast value becomes large.

As for the range of the difference in value between V0 and Vb (background contrast value), it is preferable to set the background contrast value to 200 V or less because the carrier adhesion occurs as described above when the background contrast value is larger than 200 V. On the other hand, it is preferable to set a value of 80 V or more because fogging, or the like, occurs when the background contrast value is less than 80 V.

In this manner, by adjusting Vb so as to correspond to 40% to 60% of Pmax, and controlling the charging potential V0 of the photosensitive drum 11 so that the background contrast is in a range from 80 V or more to 200 V or less, it is possible to maintain an effect of suppressing the occurrence of streak unevenness at a time of half-tone printing for a long period of time and regardless of environments, even when Vb is changed due to a change in characteristics which is caused by a change in environments, or deterioration of material such as toner.

Figure 15:
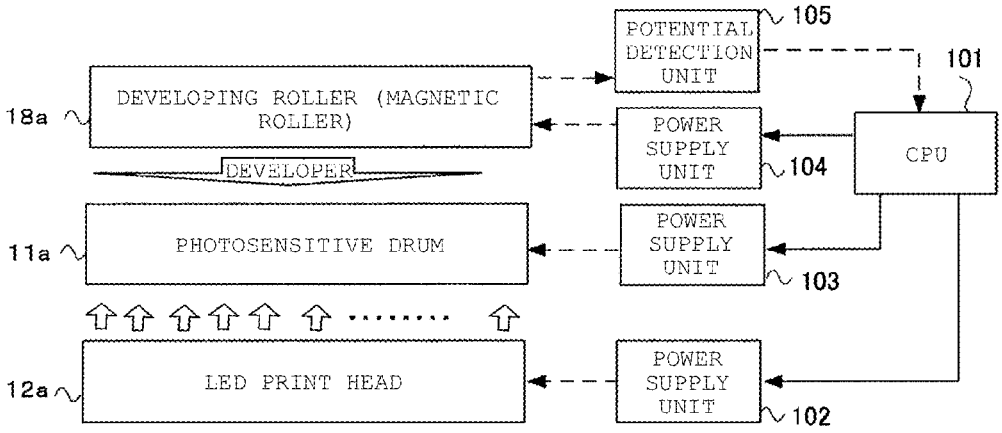
FIG. 15 is a block diagram illustrating an image forming apparatus which controls a charging potential V0 of the photosensitive drum.

FIG. 15 is a block diagram according to the embodiment in which the charging potential V0 of the photoreceptor is controlled. In the example, as illustrated, the LED print head 12, the photosensitive drum 11, and the developing roller 18 are operated due to a control of the CPU 101 through the respective power supply units 102, 103, and 104. A charging potential of the developing roller 18 is detected by a potential detection unit 105, and the CPU 101 controls the charging potential V0 of the photosensitive drum 11 by performing a driving control of the power supply unit 103 based on a detection result of the potential detection unit 105.

Here, the power supply unit 102 individually applies a current to the plurality of light emitting points of the LED print head 12 based on a control signal from the CPU 101. In addition, the power supply unit 103 applies a current to the entire photosensitive drum 11 through a charging brush (not illustrated in FIG. 15) based on a control signal from the CPU 101. The power supply unit 104 applies a current to the entire developing roller 18 in which a magnetic roller is built based on a control signal from the CPU 101.

Figure 16:
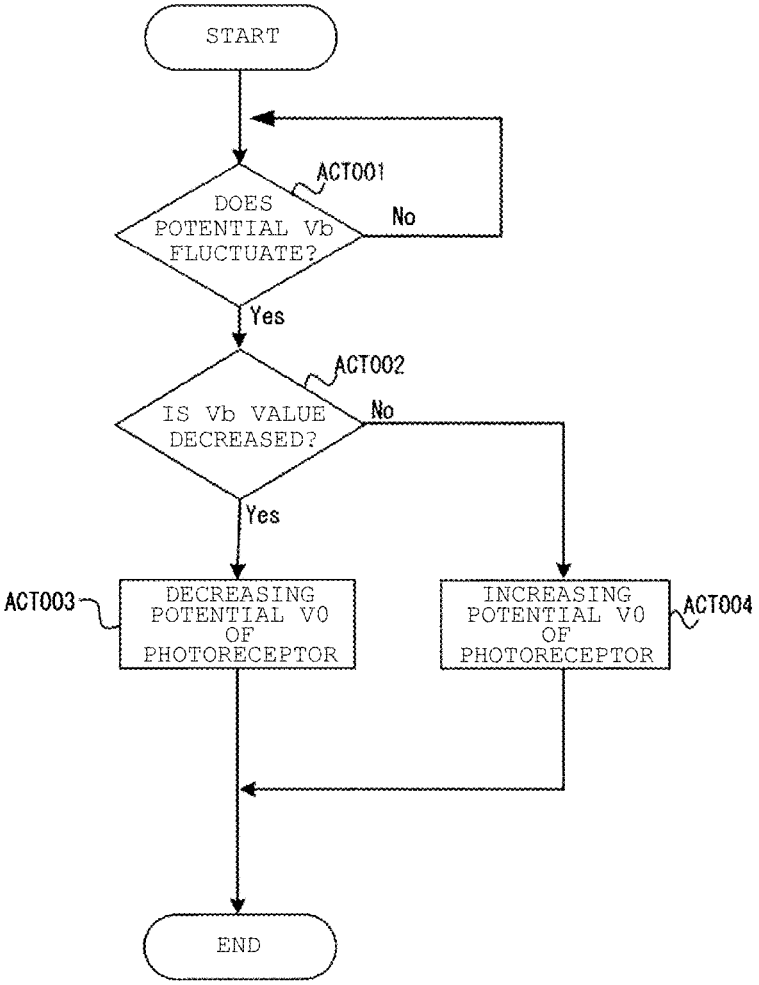
FIG. 16 is a flowchart of operations carried out when the charging potential V0 is controlled.

FIG. 16 is a flowchart of operations carried out when the charging potential V0 of the photoreceptor is controlled. The CPU 101 monitors an output signal of the potential detection unit 105, and determines whether or not the charging potential (developing bias Vb) of the developing roller 18 fluctuates (ACT 001). When it is determined that Vb fluctuates, (Yes in ACT 001), the CPU 101 determines whether Vb is decreasing or increasing (ACT 002). When it is determined that Vb is decreasing (Yes in ACT 001), the CPU 101 outputs a control signal to the potential power supply unit 103 so that the charging potential V0 of the photosensitive drum 11 is decreased to a predetermined value corresponding to the fluctuation of Vb (ACT 003). On the other hand, when it is determined that Vb is increasing (No in ACT 001), the CPU 101 outputs a control signal to the potential power supply unit 103 so that the charging potential V0 of the photosensitive drum 11 is increased to a predetermined value corresponding to the fluctuation of Vb (ACT 004).

While certain embodiments have been described, these embodiments have been presented by way of example only, and are not intended to limit the scope of invention. Indeed, the novel apparatus and methods described herein may be embodied in a variety of other forms; furthermore, various omissions, substitutions and changes in the form of the apparatus and methods described herein may be made without departing from the spirit of the inventions. The accompanying claims and their equivalents are intended to cover such forms or modifications as would fall within the scope and spirit of the inventions.

What is claimed is:

1. An image forming apparatus comprising:

a photoreceptor;

an exposure unit having a plurality of light emitting elements that is arranged in a main scanning direction of the image forming apparatus, with a density equal to or greater than 1200 dpi, and configured to emit light corresponding to an image to be formed towards the photoreceptor;

a developing unit containing toner that is transferred to the photoreceptor therefrom; and a control unit configured to control a potential of the developing unit, such that the toner is selectively transferred to a region of the photoreceptor that has received light of an intensity that is greater than a predetermined value, the predetermined value being equal to or greater than 40% and equal to or smaller than 60% of an average peak intensity of the plurality of the light emitting elements that are driven with a predetermined current value.

2. The image forming apparatus according to claim 1, wherein the control unit is further configured to cause a difference between the potential of the developing unit and a potential of the photoreceptor before the light is emitted from the exposure unit, to be a value that is greater than 80V and smaller than 200V.

3. The image forming apparatus according to claim 1, wherein the control unit is further configured to control a potential of the photoreceptor before the light is emitted from the exposure unit, based on the potential of the developing unit.

4. The image forming apparatus according to claim 3, wherein the control unit causes the potential of the photoreceptor to non-linearly change as the potential of the developing unit changes.

5. The image forming apparatus according to claim 4, wherein the control unit causes the potential of the photoreceptor to decrease as the potential of the developing unit decreases and to increase as the potential of the developing unit increases.

6. The image forming apparatus according to claim 1, further comprising:

a detection unit configured to detect the potential of the developing unit, wherein the control unit is configured to control the potential of the developing unit based on the detected potential.

7. The image forming apparatus according to claim 1, wherein the plurality of the light emitting elements includes LEDs arranged in the main scanning direction.

8. The image forming apparatus according to claim 1, wherein an average size of light spots formed by the light emitting elements on the photoreceptor is greater than 80 μm.

9. A method for forming an image comprising:

emitting, from a plurality of light emitting elements that is arranged in a width direction of a photoreceptor with a density equal to or greater than 1200 dpi, light corresponding to an image to be formed towards the photoreceptor; and controlling a potential of a developing unit such that the toner contained therein is selectively transferred to a region of the photoreceptor that has received light of an intensity that is greater than a predetermined value, the predetermined value being equal to or greater than 40% and equal to or smaller than 60% of an average peak intensity of the plurality of the light emitting elements that are driven with a predetermined current value.

10. The method according to claim 9, further comprising:

controlling a difference between the potential of the developing unit and a potential of the photoreceptor before the light is emitted from the exposure unit, to be a value that is greater than 80V and smaller than 200V.

11. The method according to claim 9, further comprising:

controlling a potential of the photoreceptor before the light is emitted towards the photoreceptor, based on the potential of the developing unit.

12. The method according to claim 11, wherein the potential of the photoreceptor is controlled to non-linearly change as the potential of the developing unit changes.

13. The method according to claim 12, wherein the potential of the photoreceptor is controlled to decrease as the potential of the developing unit decreases and to increase as the potential of the developing unit increases.

14. The method according to claim 9, further comprising:

detecting the potential of the developing unit, wherein the potential of the developing unit is controlled based on the detected potential.

15. The method according to claim 9, wherein the plurality of the light emitting elements includes LEDs arranged in the width direction of the photoreceptor.

16. The method according to claim 9, wherein an average size of light spots formed by the light emitting elements on the photoreceptor is greater than 80 μm.

* * * * *